US006568478B2

(12) United States Patent
De Almeida

(10) Patent No.: US 6,568,478 B2
(45) Date of Patent: May 27, 2003

(54) METHOD AND DEVICE TO STABILIZE THE PRODUCTION OF OIL WELLS

(75) Inventor: Alcino Resende De Almeida, Rio de Janeiro (BR)

(73) Assignee: Petroleo Brasileiro S.A. - Petrobras (BR)

( * ) Notice: Subject to any disclaimer, the term of this patent is extended or adjusted under 35 U.S.C. 154(b) by 0 days.

(21) Appl. No.: 09/788,680

(22) Filed: Feb. 21, 2001

(65) Prior Publication Data

US 2002/0040784 A1 Apr. 11, 2002

(30) Foreign Application Priority Data

Oct. 5, 2000 (BR) ..... 0004685

(51) Int. Cl.[7] ..... E21B 43/12
(52) U.S. Cl. ..... 166/372; 166/169; 166/242.5
(58) Field of Search ..... 166/372, 373, 166/63, 69, 162, 169, 321, 325, 242.5

(56) References Cited

U.S. PATENT DOCUMENTS

| | | | | |
|---|---|---|---|---|
| 1,761,363 A | | 6/1930 | Porter | |
| 2,697,988 A | | 12/1954 | Stewart | |
| 3,784,325 A | | 1/1974 | Coanda et al. | |
| 5,105,889 A | | 4/1992 | Misikov et al. | |
| 5,743,717 A | * | 4/1998 | Schmidt | 417/109 |
| 6,041,803 A | * | 3/2000 | De Almeida et al. | 137/14 |
| 6,250,384 B1 | * | 6/2001 | Beauquin | 166/105.5 |

FOREIGN PATENT DOCUMENTS

| | | |
|---|---|---|
| WO | WO 96/07813 | 3/1996 |
| WO | WO 98/21447 | 5/1998 |
| WO | WO 00/00715 | 1/2000 |
| WO | WO 00/05484 | 2/2000 |

OTHER PUBLICATIONS

Faustinelli et al; "A solution to instability problems in continuous gas–lift wells offshore Lake Maracaibo";Apr. 21–23, 1999; Abstract.

* cited by examiner

*Primary Examiner*—William Neuder
(74) *Attorney, Agent, or Firm*—Nixon & Vanderhye PC

(57) ABSTRACT

The present invention relates to a method and a device to stabilize the production of oil wells. The device is used in a tubing of an oil well and it is intended to overcome the harmful effects provoked by the unstable flow of multiphase flows which are produced by some oil wells. In an oil well producing by means of continuous gas lift a device is installed into the tubing, said device being provided with a first portion, which provides a progressive constraint in the area for the passage of the flow coming from the reservoir, a second medium portion, located above the first portion, located above the first portion, which makes said area for the passage of the flow coming from the reservoir to be substantially constant at this point and smaller than the original area of the tubing, and a third upper portion, located above the second medium portion, which provokes a progressive widening in said area for the passage of the flow coming from the reservoir, until such area for the passage of the flow is again equal to the original area of the tubing. Such device can be located in front of the gas lift valve through which the injection gas is injected.

36 Claims, 13 Drawing Sheets

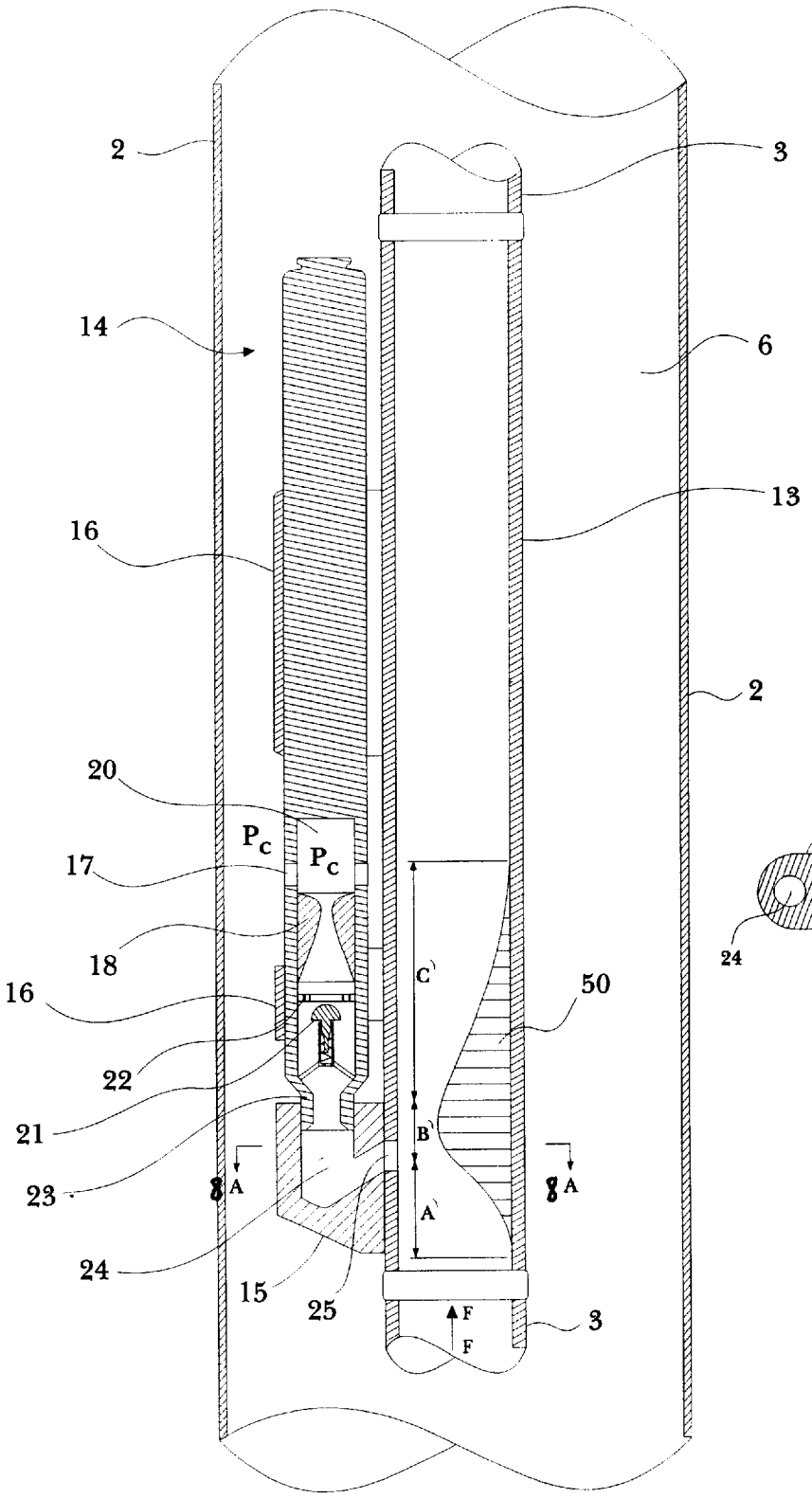
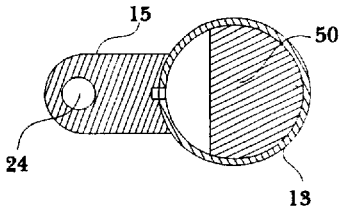
Fig. 8a
Fig. 8

METHOD AND DEVICE TO STABILIZE THE PRODUCTION OF OIL WELLS

CROSS REFERENCE TO RELATED APPLICATION

This application is based upon and claims priority from Brazilian Patent Application No. PI 0004685-0 filed Oct. 5, 2000, the contents of which are incorporated herein by reference.

BACKGROUND OF THE INVENTION

1. Field of the Invention

The present invention relates to a method and device to stabilize the production of oil wells. The device may be used with an oil production pipe and is intended to overcome the harmful effects caused to the well by the flow of unstable mixtures produced by certain wells. More particularly, the present invention is preferably related to a device which is used with a flow pipe of an oil well equipped to produce oil by means of gas lift, and to a method for its use.

2. Description of the Related Art

Oil is usually found in accumulations under pressure in the subsoil, in porous and permeable sandstone known as reservoir stones, or else hydrocarbon producing rock formations. Wells are drilled from the surface to drain off such reservoirs so as to communicate the reservoir with processing facilities in the surface, which are assembled to collect and to treat the produced fluids.

The wells are bores which traverse several rocking formations. Usually a steel pipe is inserted into such bores, and is called a casing. At least one pipe of smaller diameter is inserted into such casing, through which fluids from the reservoir flow.

Oil is a complex mixture of heavy and light hydrocarbons, comprising from dry gas (methane) to heavy oil. Depending on the features of the reservoir, some components may appear in higher concentration than other. Other substances may also accompany the produced oil, such as water, carbonic gas, hydrogen sulfide gas, salts and sand, only to mention some examples.

Depending on the conditions of pressure and temperature, the constituents of the oil may be in the gaseous phase or in the liquid phase. Thus, it is concluded that the fluids that usually flow into an oil well may be defined as a multi-phase multi-component mixture.

The flow of the fluids into an oil well, from the reservoir to the surface, can occur as a consequence of the accumulated energy in the reservoir, that is, without the presence of an external source of energy which provokes such production. In such a case it is said that the production of the well is normally flowing, or else it is said that the well is producing by surge. When an external source of energy is used, e.g. a down hole pump, there is then what is called an artificial lift.

Among the various known artificial lift methods the continuous gas lift can be noted. In a usual configuration for this method, natural gas at high pressure is injected into an annulus formed between the casing and the pipe through which the production of fluids from the reservoir flows, which is also named the production string or tubing.

Valves known as gas lift valves are located at certain points along the tubing, which control the flow of gas flowing from the annulus to the interior of the tubing. The expansion of such pressurized gas provides the necessary additional energy to allow fluids from the reservoir to flow at a certain flow rate.

In some oil wells the flow of fluids into the tubing occurs in an unstable way, that is, there are variations of pressure and flow rate with time, which can even be harmful to the integrity of the well and its associated equipment.

There are in the technical literature many citations of severe cases in which unstable flows in oil wells cause a halt in production. Such instabilities are also known as "heading", as it is at the surface, at the well head, where they are more vigorously sensed, and such instability is able to occur in the tubing, in the annulus, or in both.

The phenomenon of the instability in the flow of multiphase mixtures is complex, and the causes for such instability are not totally understood. Generally, small disturbances give rise to great variations in the flow rates of the produced oil and the injected gas, as well as in the pressures. Many times such phenomenon is characterized by being cyclical.

In the article "These methods can eliminate or control annulus heading", by A. W. Grupping, C. W. F. Luca e F. D. Vermeulen (Oil&Gas Journal, Jul. 30, 1984, p. 192), the authors show that the unstable behavior of the flow in wells producing by means of continuous gas lift may frequently be attributable to the pressure oscillations in the annulus formed between the tubing and the casing. According to the authors, keeping the pressure constant causes the flow in such wells to stabilize.

The control of the injection of gas in wells equipped to produce by means of continuous gas lift is usually made by a gas choke valve, located at the surface, and by another valve located at a certain point in the tubing, which is the gas lift valve.

According to Grupping, Luca and Vermeulen, and some others, the ideal situation is to remove the control from the surface, allowing it to be made only by means of the gas lift valve. The authors also recommend that the gas lift valve be provided with an internal passage comprising a single orifice. However, this is not enough to keep the flow rate constant.

The conventional gas lift valves used to control the flow rate of injected gas in wells equipped to produce by means of continuous gas lift are not really valves, although they are designated as valves by the experts and by the manufacturers. Actually they are flow regulators equipped with a small disc provided with a round orifice having a certain diameter. The edges of the orifice are usually sharp or smoothly rounded.

Such gas lift "valves" are also provided with a check valve, located downstream of the orifice, so as to preclude an undesirable flow of oil from the tubing to the annulus to occur.

When a gas flows throughout a constriction, such as an orifice, and the pressure upstream of the orifice is kept constant, the flow rate of the flowing gas increases as the pressure downstream of the orifice decreases, until, for a certain upstream pressure known as critical pressure, the sonic speed of the constriction is achieved. From then on a decrease in the pressure downstream of the constriction will not cause the injected gas flow rate to raise.

Thus, there are two dynamic behaviors, or rates of flow, for a valve provided with an orifice. The first can be defined as a sub-critical rate of flow, in which a reduction in the downstream pressure causes a raise in the gas flow rate, and the second can be defined as a critical rate of flow, in which the gas flow rate is constant, independently of the downstream pressure (considering a constant upstream gas pressure).

In use, the pressure upstream of the orifice is basically the pressure of the injection gas existing in the annulus at the position where the gas lift valve is installed, and the pressure downstream of the orifice is basically the pressure of the flow of fluids into the tubing at the position where the gas lift valve is installed.

Thus, according to the above technical literature, in a situation where the flow is critical the use of the gas lift valve contributes to stabilize the flow into the well, as in this situation the flow rate of injection gas is constant (assuming that the pressure in the annulus is constant).

However, due to the irreversible losses of energy in a gas flow passing through such orifices, deriving basically from the heat, the friction and the sound coming from the extremely turbulent flow of gas under pressure passing through the orifice, there is a necessity for the pressure into the tubing being essentially less than 55% of the existing pressure in the annulus so as a critical flow is achieved.

Such differential of pressure is not usually found in most of the actual cases, and consequently the orifice valve operates in a sub-critical rate of flow, the variation in the gas flow caused by the variation of pressure into the tubing contributing to the instability of the flow in the well.

The Brazilian patent application PI9300292-0, commonly owned by the applicant and the description of which is herein incorporated for reference, contributed for the solution of the above problem by substituting a venturi for the orifice of sharp edges in the gas lift valves.

According to this document, the irreversible losses of energy in the injection gas flow are significantly smaller, and the increasing of the pressure in the diffusor of the venturi causes a critical flow to be achieved for a pressure in the tubing substantially smaller than 90% of the annulus pressure. Therefore, a critical flow is achieved more easily.

Consequently it is easier to keep constant the injection gas flow rate which, as previously mentioned, contributes to stabilize the flow into the tubing. Further, the smaller differential of pressure required by the gas lift valve with a venturi for injecting a certain flow of gas into the tubing provokes a more rational use of the available energy, thereby causing the costs for compressing gas to reduce (for the same oil flow rate), or increasing the income as a consequence of an increase in the production flow rate, be it for increasing the injection gas flow rate or injecting gas at a deeper position in the well.

However, in actual situations, the stabilization of the oil production is not always achieved simply using the gas lift valve with a venturi. Although a critical flow is achieved for tubing pressures higher than those in the situation where a conventional orifice is used, such tubing pressure is still low in severe instability situations.

The injection of gas by means of a gas lift valve with a venturi operating at a sub-critical rate of flow is even more harmful to the well than by means of gas lift valve with an orifice, and the instability can eventually augment. The sub-critical rate of flow in a gas lift valve with a venturi occurs in a range of 55% to 100% of the annulus pressure. In a gas lift valve with a venturi such range is reduced for 90% to 100%.

Thus, in a gas lift valve with a venturi operating at a sub-critical rate of flow the variation of pressure is about 4.5 times higher than a gas lift valve with an orifice operating at a sub-critical rate of flow. Such features of the gas lift valves with a venturi also makes it difficult to use such valves to inject gas at a deeper location, due to the existing uncertainty for calculations in a multiphase flow.

A mistake in the calculation can result in positioning the gas lift valve with a venturi at a location where the injection occurs in a sub-critical rate of flow (highly undesirable) or is even not possible (where the tubing pressure is higher than the annulus pressure). Thus, the use of a gas lift valve with a venturi is not the ultimate solution for all the cases where the well produces with instability.

There is then a need for a new solution to overcome the problem of stabilizing the production of an oil well, in particular in oil wells producing by means of continuous gas lift. Further, there is a need for a solution which enables the injection of gas at a deeper point in oil wells which produce by means of continuous gas lift.

SUMMARY OF THE INVENTION

The present invention relates to a method and device to stabilize the production of oil wells, the device intended to be inserted into the tubing of an oil well, which usually comprises:

- a wellhead;
- casing;
- a tubing inserted into the casing;
- a packer inserted and locked into the casing and connected to the tubing next to an oil reservoir, so as to create two discrete regions:
  - a lower chamber, extending downwardly from the packer to the reservoir; and
  - an upper chamber, or annulus, extending upwardly from the packer to the wellhead.

In a first aspect the invention provides an oil well comprising:

- a tubing for carrying fluids coming from a reservoir to the surface;
- a body inserted in the tubing, the body comprising:
  - a first portion that progressively reduces, in a direction of fluid flow in said tubing, a cross-sectional flow area for the passage of fluid;
  - a second portion, disposed downstream of said first portion with respect to the direction of fluid flow in said tubing, that defines a substantially constant cross-sectional flow area for the passage of fluid, said constant cross-sectional area being smaller than an unobstructed interior cross-sectional area of said tubing; and
  - a third portion, disposed downstream of said second portion, that progressively increases, in the direction of fluid flow in said tubing, a cross-sectional flow area for the passage of fluid.

In a second aspect the invention provides a body to stabilize the production of oil wells when provided to a tubing for carrying fluids coming from a reservoir; said body comprising:

- a first portion which progressively increases in cross sectional area from a distal end thereof causing a progressive decrease, in a direction of fluid flow from said reservoir, in a cross-sectional area available for the passage of fluid from said reservoir when said body is inserted inside said tubing;
- a second portion disposed adjacent to said first portion which has a substantially constant cross-sectional area defining a substantially constant cross-sectional area available for the passage of fluid when said body is inserted inside said tubing, said constant area being smaller than an unobstructed interior cross-sectional area of said tubing; and a third portion disposed adjacent to said second portion which progressively decreases in cross-sectional area from a distal end thereof causing a progressive increase, in the direction of fluid flow, in a cross-sectional area available for the passage of fluid when said body is inserted inside said tubing.

In a third aspect the invention provides a device to stabilize the production of oil wells, said device comprising:

a body to stabilize the production of oil wells when provided to a tubing for conducting fluids coming from a reservoir; said body comprising:

a first portion which progressively increases in cross-sectional area from a distal end thereof causing a progressive decrease, in a direction of fluid flow from said reservoir, in cross-sectional area available for the passage of fluid when said body is inserted inside said tubing;

a second portion disposed adjacent to said first portion which has a substantially constant cross-sectional area defining a substantially constant cross-sectional area available for the passage of fluid when said body is inserted inside said tubing, said constant area being smaller than an unobstructed interior cross-sectional area of said tubing;

a third portion disposed adjacent to said second portion which progressively decreases in cross-sectional area from a distal end thereof causing a progressive increase, in the direction of fluid flow, in a cross-sectional area available for the passage of fluid when said body is inserted inside said tubing; and a nipple tubing surrounding, and attached to, said body, said nipple tubing being insertable into said tubing of an oil well.

In a fourth aspect the invention provides a method to stabilize the production of oil wells comprising tubing for carrying to the surface the fluids coming from a reservoir, the method comprising:

inserting into said tubing a device comprising:

a first portion that progressively reduces, in a direction of fluid flow, a cross-sectional flow area for the passage of fluid flowing from said reservoir;

a second portion, disposed vertically above said first portion, defining a substantially constant cross-sectional flow area for the passage of fluid coming from said reservoir and smaller than an unobstructed interior cross-sectional area of said tubing;

a third portion, disposed vertically above said second portion, defining a progressively increasing, in a direction of fluid flow, cross-sectional area for the passage of fluid coming from said reservoir, until said cross-sectional area for the passage of fluid is equal to an unobstructed interior cross-sectional area of said tubing;

allowing fluids from said reservoir to flow towards said surface past said device, whereby said flow is accelerated when it passes said first portion, and consequently the flow pressure is decreased, said flow then, passing said second portion, and then passing said third portion, where said flow is decelerated, and consequently the flow pressure is increased, the above sequence causing a stabilization of said flow.

If the oil well is equipped to produce by means of continuous gas lift, a gas lift mandrel should be connected to the tubing and a gas lift valve should be connected to the gas lift mandrel. Injection gas at a high pressure should be injected at the wellhead in the annulus between the casing and the tubing of the oil well.

The gas lift valve should be provided with at least one port through which the high pressure injection gas of the annulus flows towards the interior of the tubing, and the device to stabilize the production must be inserted into the tubing with its medium portion located in front of the point where the high pressure injection gas is injected into the tubing.

BRIEF DESCRIPTION OF THE DRAWINGS

The invention will be now described in more detail, by way of example only, with reference to the attached schematic drawings in which:

FIG. 8 is a longitudinal cross section view depicting a conventional gas lift mandrel having a venturi type gas lift valve connected to it, a device to stabilize the production of the present invention being provided into the tubing;

FIG. 8A depicts a cross section in the gas lift mandrel of the FIG. 8, taken along the line 8A—8A in FIG. 8;

DETAILED DESCRIPTION OF THE PREFERRED EMBODIMENTS

Figure 1:
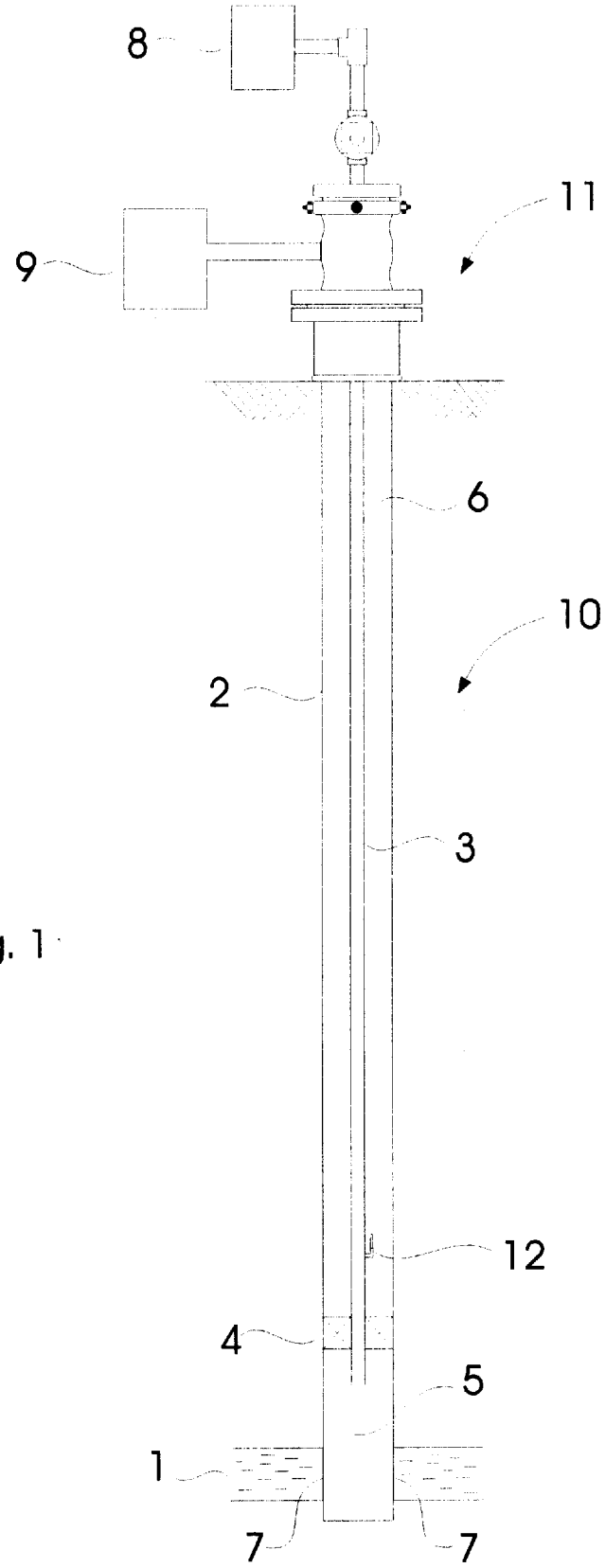
FIG. 1 is a longitudinal cross-sectional view depicting an oil well equipped to produce by means of continuous gas lift.

FIG. 1 is a schematic longitudinal cross-sectional view depicting a typical gas lift facility showing an oil well 10 equipped to produce by means of continuous gas lift. The oil well 10 is basically a hole extending through a number of rock formations from the surface to an oil reservoir 1. The oil well 10 is provided with a casing 2, a tubing 3 being inserted into the casing 2.

A packer 4 is installed into the oil well 10, next to the reservoir 1, and its function is to create two discrete zones in the oil well 10, a first lower chamber 5, located next to the reservoir, and a second upper chamber or annulus 6, formed between the casing 2 and the tubing 3, the packer 4 providing a seal between the chambers. At the surface there are facilities used to keep operation of the well safe, these facilities known by the experts as wellhead 11.

Fluids from the reservoir 1 enter the oil well 10 by means of small orifices 7, which were previously drilled in the casing 2. Next the fluids flow into the tubing 3 up to the wellhead 11, where they are directed to the processing facilities 8, which are schematically depicted in the FIG. 1.

In a continuous gas lift system injection gas at a high pressure coming from an external source of high pressure gas 9, schematically shown in FIG. 1, is admitted into the annulus 6. The high pressure injection gas flows into the annulus 6 and passes to the tubing 3 through a gas lift valve connected to a gas lift mandrel 12 which is connected to the tubing 3. The high pressure injection gas mingles with the fluids coming from the reservoir 1, and the resultant mixture is carried to the surface.

Although in FIG. 1 there is shown a single mandrel 12 for installing a gas lift valve, the oil wells producing by such means are usually provided with a number of mandrels, which are spaced apart along the tubing and which are each equipped with gas lift valves, the gas lift valves being not necessarily of the same type.

However, in actual use the injection of high pressure injection gas is made by means of a single gas lift valve, known as the operating gas lift valve. Some other gas lift valves are also installed in the oil well, but they are used to assist the start-up or to restart the oil well production, and these gas lift valves are known as start-up valves.

The oil wells equipped to produce by means of continuous gas lift may have other types of configuration than the configuration shown in the FIG. 1. Such oil wells may be onshore or offshore oil wells. The offshore oil wells may be equipped with dry wellheads, usually located at a platform, or wet wellheads, that is, the wellhead is located at the seabed.

Moreover, in any of the abovementioned configurations use may be made of a single tubing 3, as shown in FIG. 1, or more than one tubing may be used instead (double completion, triple completion, etc.).

Whatever is the configuration of an oil well it is able to benefit from the device of the present invention, as the type of configuration of the well will not affect the performance of the device. Therefore, the configuration schematically depicted in FIG. 1 suffices for oil industry experts to understand the operation of the device of the present invention, and it will be quite clear that the device can be used with any tubing, as will be seen from here on.

Figure 2:
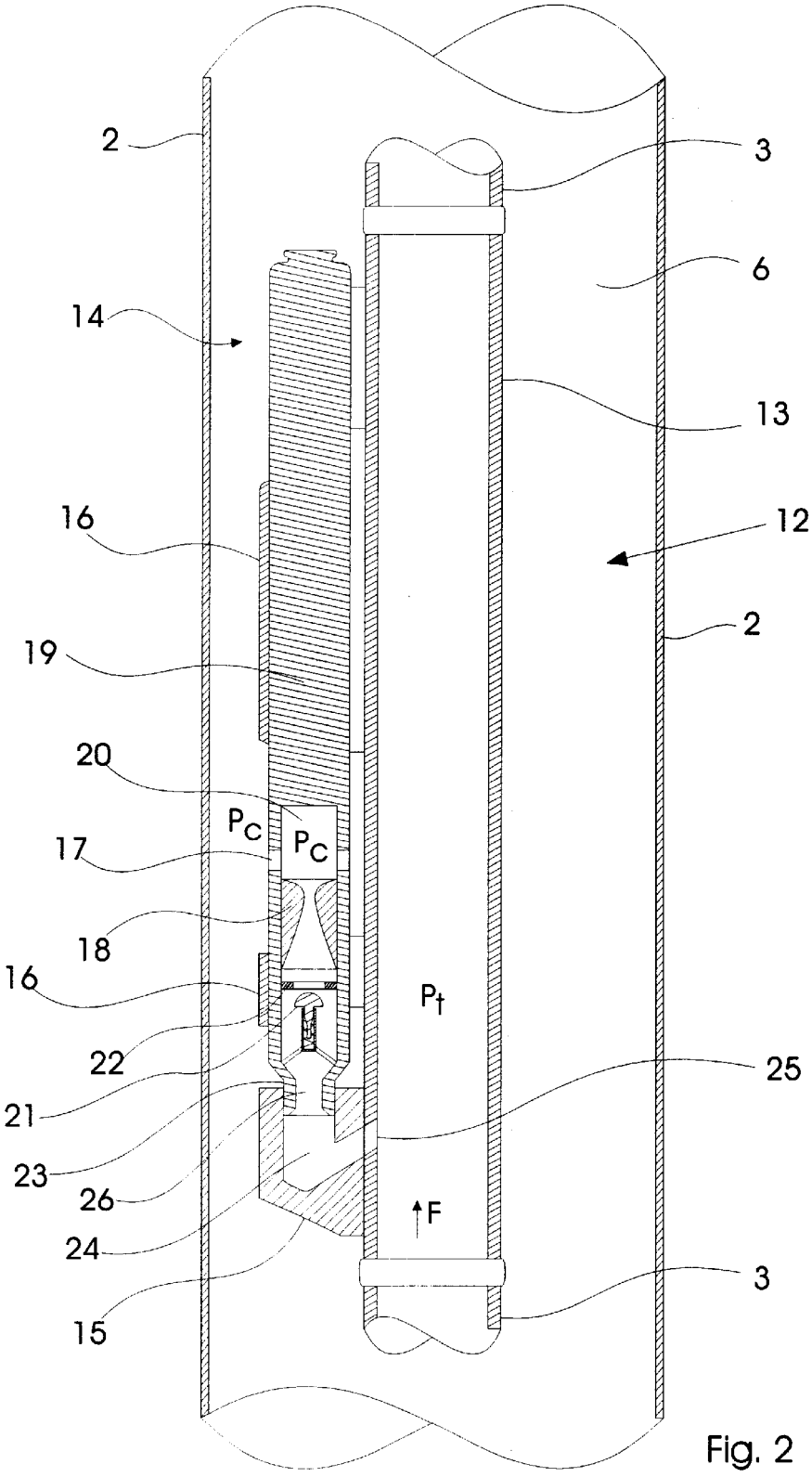
FIG. 2 is a longitudinal cross-sectional view depicting a conventional gas lift mandrel having a venturi type gas lift valve connected to it.

There are two types of gas lift mandrels, namely the conventional one and the side pocket one. FIG. 2 depicts a longitudinal cross section of a conventional gas lift mandrel 12 comprising a body 13, which is a segment of pipe having the same internal diameter as the tubing of the oil well, and a side support 15, to which a gas lift valve 14 is connected. The body 13 is provided with threads at both ends for allowing it to be connected to the tubing 3, whereby the conventional gas lift mandrel 12 is in line with the tubing 3.

The gas lift valve 14 is of the type which is provided with a venturi, and it comprises a body 19; an internal chamber 20; a gas intake port 17; a concentric venturi 18 located in the internal chamber 20; a check valve assembly located immediately below the concentric venturi 18, and which in the presently illustrated case is formed by a shutter 21, a seating 22 and a tip 23 provided with an opening 26.

The tip 23 is provided with threads at its outer portion, so as to enable the gas lift valve 14 to be connected to the conventional gas lift mandrel 12 by screwing the tip 23 in the support 15, with side supports 16 being provided in the conventional gas lift mandrel 12 for lateral support of the body 19 of the gas lift valve 14.

The support 15 is provided with an internal chamber 24, which communicates with an end of the hollow tip 23 of the gas lift valve 14. The other end of the internal chamber 24 of the support 15 is connected to an opening 25 existing in the body 13 of the conventional gas lift mandrel 12.

Thus injection gas at a high pressure from the annulus 6 is able to enter the tubing 3, passing then successively through the concentric venturi 18, through the check valve assembly formed by the shutter 21 and the seat 22, through an opening 26 of the tip 23, through the internal chamber 24 of the support 15 and through the opening 25 in the body 13, entering then into the body 13 of the conventional gas lift mandrel 12.

Fluids coming from the reservoir flow upwardly into the segment of the tubing 3 located below the conventional gas lift mandrel 12, in the direction indicated by the arrow F, passing then into the body 13 of the conventional gas lift mandrel 12.

When passing in front of the opening 25 the fluids receive an injection of injection gas at a high pressure coming from the opening 25, whereby the fluids of the flow mix with the injected high pressure injection gas, and such mixture in then carried to the surface by means of the segment of the tubing 3 located above the conventional gas lift mandrel 12.

Such conventional gas lift mandrel 12 has a disadvantage in that it is necessary to retrieve the entire tubing string to replace the gas lift valve, when it is necessary.

Figure 3:
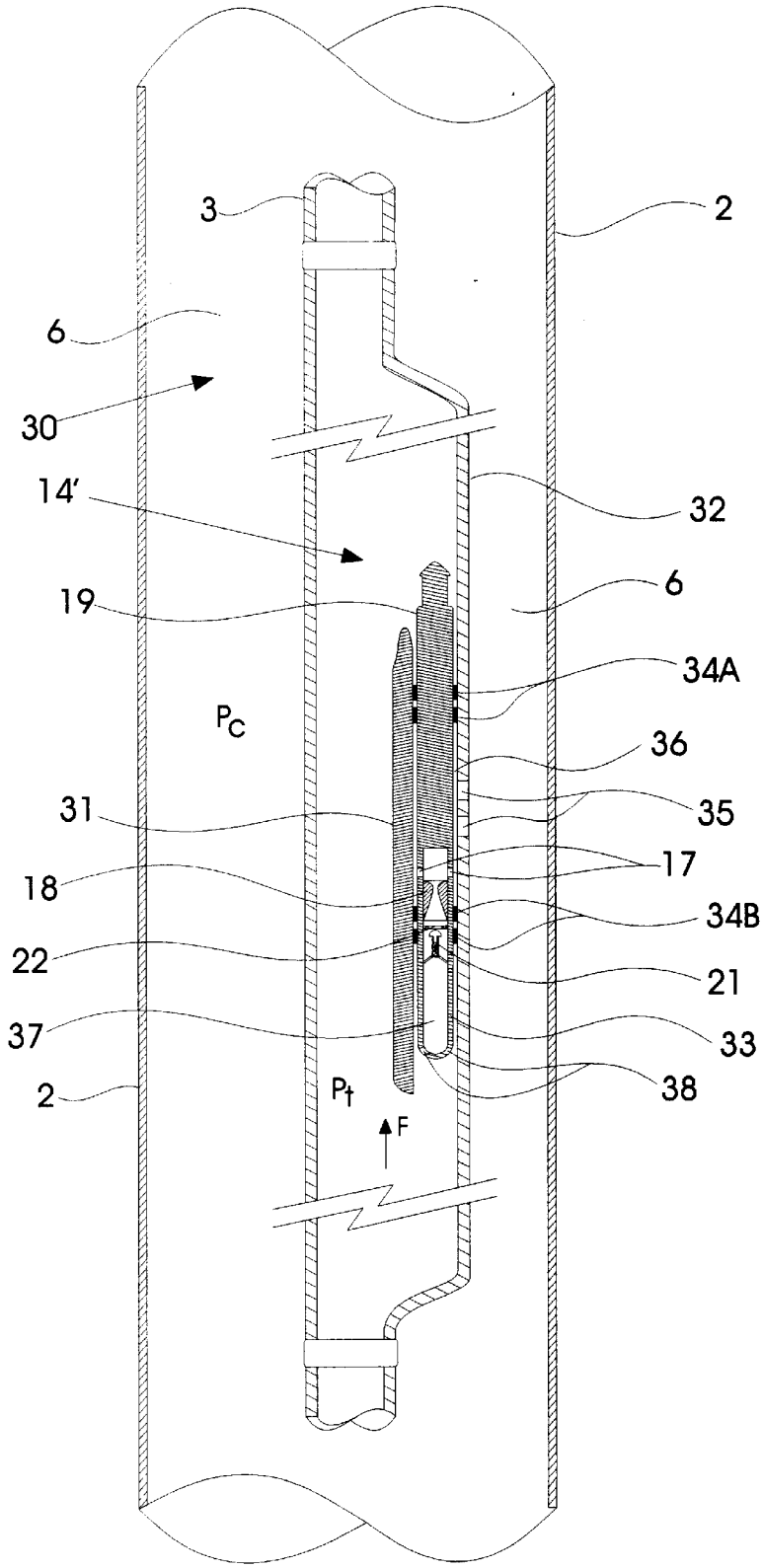
FIG. 3 is a longitudinal cross-sectional view depicting a side pocket gas lift mandrel having a venturi type gas lift valve connected to its side pocket.

FIG. 3 depicts a longitudinal cross section of a side pocket gas lift mandrel 30 having a venturi type gas lift valve 14' inserted in a side receptacle 31 of the side pocket 32 of the side pocket gas lift mandrel 30. As with the conventional gas lift mandrel 12 of the FIG. 2, the side pocket gas lift mandrel 30 is provided with threads in both ends, so as to allow it to be connected to the tubing 3.

The side pocket gas lift mandrel 30 is designed in such a way that a venturi type gas lift valve 14' can be replaced, when necessary, without the need to retrieve the entire tubing 3. Such replacement is made by means of an operation using special tools which are inserted and lowered into the tubing by means of a cable or a wireline, such operation being well known by those skilled in the art.

The venturi type gas lift valve 14' is substantially equal to the one which has been described with respect with the conventional gas lift mandrel 12 of FIG. 2, except for being provided with a tip 33, distinct from the tip 23 of FIG. 2. Therefore, the venturi type gas lift valve 14' will not be described here again, and the same numeral references for its parts will be used as those used with respect to FIG. 2.

The venturi type gas lift valve 14' is introduced into the receptacle 31 of the side pocket 32, where it is kept under pressure due to the compression exerted by gaskets 34*a* and 34*b*, which also provide the necessary seal between the body 19 of the venturi type gas lift valve 14' and the receptacle 31.

Injection as at a high pressure coming from the annulus 6 enters through openings 35 existing in the side pocket 32 into the small annulus 36 formed between the receptacle 31, the venturi type gas lift valve 14' and the side pocket 32. Such small annulus is kept sealed by the gaskets 34*a* e 34*b*.

Next the high pressure injection gas enters into the venturi type gas lift valve 14', through openings 17, passes through the concentric venturi 18 and the check valve assembly formed by the shutter 21 and the seat 22, enters the internal chamber 37 of the tip 33, and finally it exit through discharge openings 38 located at the lower end of the tip 33, mixing then with the fluids coming from the reservoir 1, as will be seen in the following.

Fluids coming from the reservoir flow upwardly into the segment of the tubing 3 located below the side pocket gas lift mandrel 30, in the direction indicated by the arrow F in the FIG. 3, passing then into the side pocket gas lift mandrel 30.

When passing in front of the discharge openings 38 of the tip 33 of the venturi type gas lift valve 14' the fluids receive an injection of injection gas at a high pressure coming from the discharge openings 38, whereby the fluids of the flow mix with the injected high pressure gas, and such mixture in then carried to the surface by means of the segment of the tubing 3 located above the side pocket gas lift mandrel 30.

Considering a fixed diameter of the throat of the venturi 18, the injection gas flow rate passing through it is a function of the pressures upstream and downstream of the venturi. The pressure upstream of the venturi is the pressure $P_c$ of injection gas existing in the annulus 6, the losses of energy in the openings 17 being not taken into consideration for purposes of simplification of the description.

The pressure downstream of the venturi 18 is the pressure $P_t$ existing in the tubing 3 immediately after the region where the venturi 18 is located, the losses of energy in the internal passage of the tip 23, 33, and in the discharge openings 25, 38 being not taken into consideration for purposes of simplification of the description. If the pressure $P_t$ is higher or equal to the pressure $P_c$, a flow of injection gas from the annulus 6 to the interior of the tubing 3 will not occur. Note that the flow of fluids from the tubing 3 to the annulus 6 is prevented by the check valve assembly.

If the pressure $P_t$ is smaller than the pressure $P_c$, a flow of injection gas from the annulus 6 to the interior of the tubing 3 will occur. Considering the case when the pressure $P_c$, is constant, as the pressure $P_t$ decreases the gas flow rate will then increase, up to a time when the pressure $P_t$ reaches the value of the critical pressure $P_{tcr}$, when the sonic speed of injection gas flow occurs in the throat of the venturi 18.

From then on an increase in the flow rate of the injection gas will not occur, even if the pressure $P_t$ is reduced. It is supposed that in the venturi type gas lift valve the ratio of the pressure $P_{tcr}/P_c$ is approximately 0,9. Thus, the pressure $P_t$ can be at most 90% of the value of the pressure $P_c$ to provoke a constant injection gas flow which tends to stabilize the oil well.

The above analysis of the behavior of the flow rate of the injection gas as a function of the annulus pressure $P_c$ and the tubing pressure $P_t$ applies to both the conventional gas lift mandrel 12 and the side pocket gas lift mandrel 30.

As has been seen, the pressure $P_t$ can be at most equal to 90% of the value of the pressure $P_c$ for creating a critical flow of injection gas throughout the venturi type gas lift valve so as to produce an injection gas flow rate that is constant (when the pressure $P_c$ is constant).

The value of the pressure $P_t$ must be equal to or smaller than 90% of the value of the pressure $P_c$ for creating a constant flow rate of injection gas, which is desirable. However, such condition is not always feasible, and it is desired to provide a device that provokes this condition to always occur. The present invention provides a device and a method which alleviates this and other problems.

Figure 4:
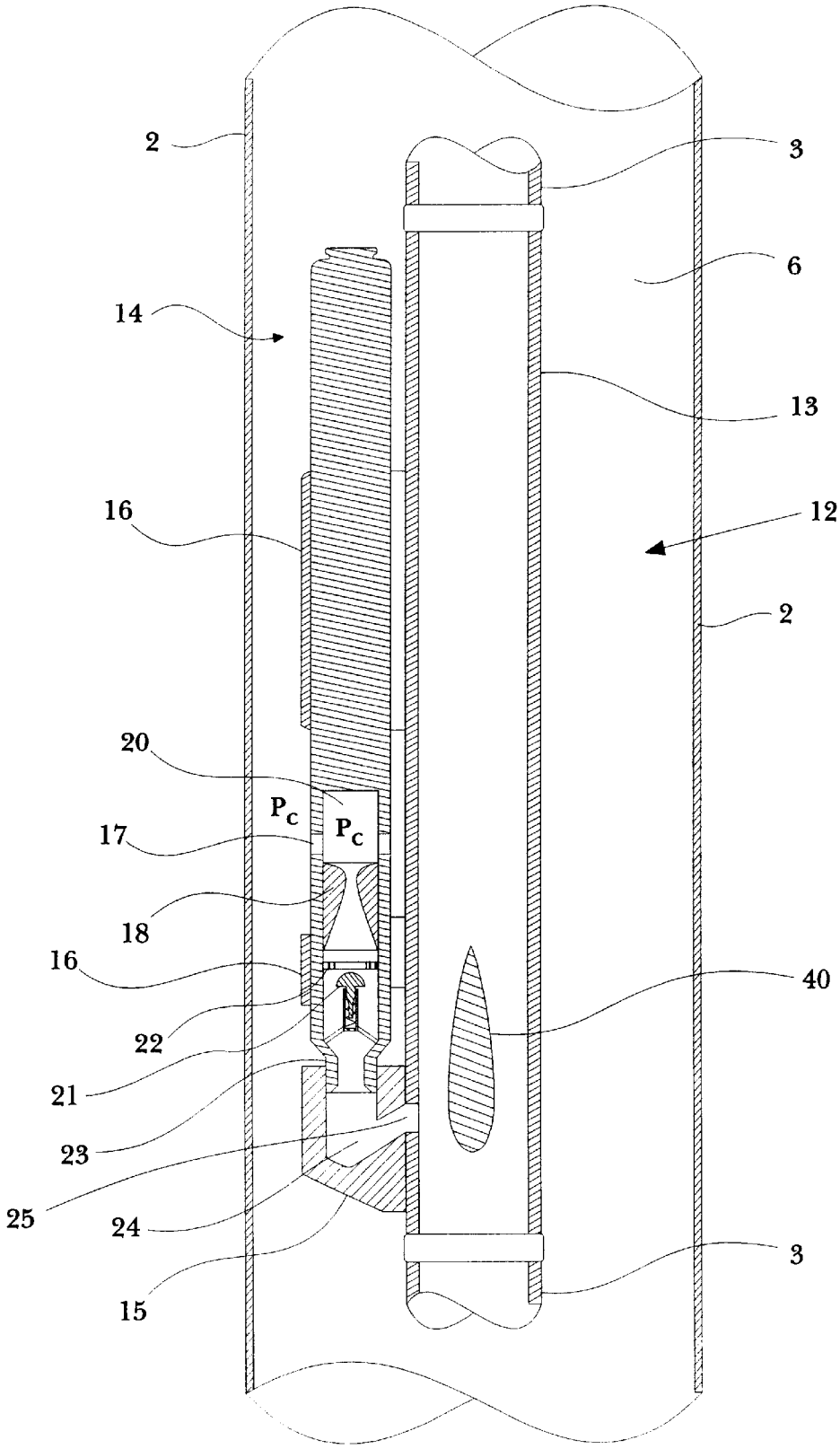
FIG. 4 is a longitudinal cross-sectional view depicting a conventional gas lift mandrel having a venturi type gas lift valve connected to it, a device to stabilize the production of the present invention being provided into the tubing.

FIG. 4 depicts a first embodiment of the device to stabilize the production of oil wells of the present invention, in the case where a conventional gas lift mandrel 12 is used. In this embodiment the device comprises a central body venturi 40 fixed into the body 13 of a conventional gas lift mandrel, which is connected to the tubing 3.

The central body venturi 40 is located in the region where a gas lift valve 14 is installed in a conventional gas lift mandrel 12, in such a way that the opening 25 from which gas at a high pressure is coming from the gas lift valve 14 enables the injection gas to be injected towards the throat of the said central body venturi 40, as will be seen in more detail later.

Figure 5:
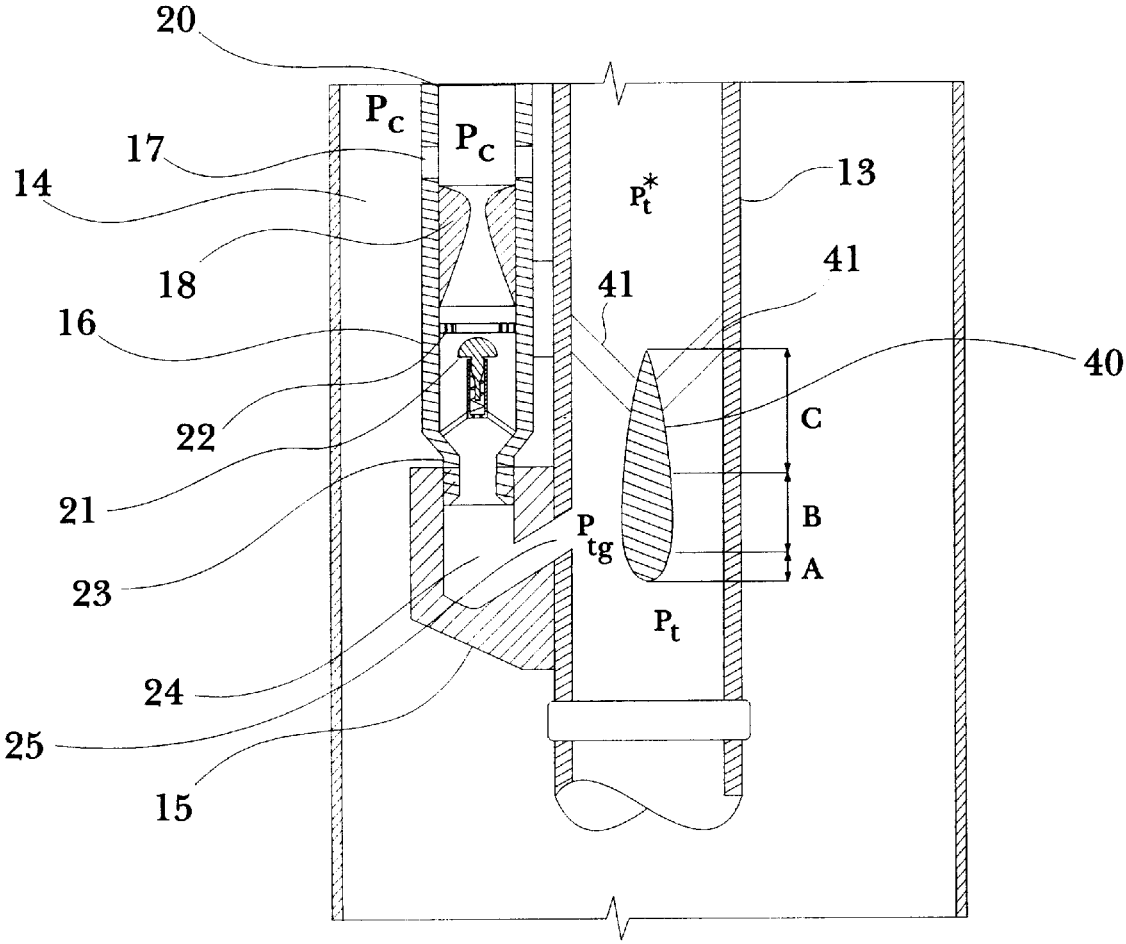
FIG. 5 is a longitudinal cross-sectional view depicting a detail of FIG. 4.

FIG. 5 depicts the central body venturi 40 in more detail. The central body venturi 40 comprises a central aerodynamic element of a round cross section installed into the tubing 3 in such a way that its longitudinal axis is substantially coincident with the longitudinal axis of the body 13 of the conventional gas lift mandrel 12. In the present embodiment fixing rods 41 are used to keep the central body venturi 40 centered into the body 13 of the conventional gas lift mandrel 12, although other fixing elements may be used.

The longitudinal cross-section of the central element, which is shown in the FIGS. 4 and 5, indicates, as in the conventional concentric venturis, that there can be considered three regions of the central body venturi 40, namely:

- a first region 'A', that progressively reduces, in a direction of fluid flow in said tubing 3, the cross-sectional area of the annulus formed between the central body venturi 40 and the internal walls of the body 13 of the conventional gas lift mandrel 12, through which the flow of fluids coming from the reservoir 1 passes, thereby resulting in the flow being accelerated and the flow pressure being reduced in the first region 'A';
- a second region 'B', where the area of the cross section of such annulus is constant; and
- a third region 'C', where the area of the cross section of such annulus is progressively increased up to the point that it is equal to an unobstructed interior cross-sectional area of said tubing, thereby resulting in the flow being decelerated and the flow pressure being increased in the second region 'B'.

Making a comparison between the concentric venturis, it can be said that, for the sake of simplification and clarity, that the first region 'A' corresponds to the nozzle, the second region 'B' corresponds to the throat, and the third region 'C' corresponds to the diffusor. Such nomenclature will be used hereon when referring to the three regions of the central body venturi 40.

With the central body venturi 40 located into the body 13 of the conventional gas lift mandrel 12, as shown in the FIG. 5, the pressure in the opening 25, which is basically the pressure upstream of the venturi 18 of the gas lift valve, is no longer the pressure $P_t$ of the flow which is passing through the gas lift mandrel 12.

The pressure in the opening 25 instead takes a value $P_{tg}$, which is the existing pressure at the throat (second region 'B') of the central body venturi 40, as the flow is accelerated when passing through the nozzle (first region 'A'), as previously explained, and the flow pressure consequently is reduced there. Thus, the pressure $P_{tg}$ is smaller than the pressure $P_t$, and such differential of pressures is a function of the constriction rate, that is, the reduction in the area at the throat (second region 'B').

An increase in the flow pressure occurs at the diffusor (second region 'B') of the central body venturi 40. The value of the $P_t$* downstream of the central body venturi 40 is a result of the composition of the effect of the irreversible losses of energy in the injection gas flow along the central body venturi 40 and of the effect caused by the introduction of the kinetic energy in the injection gas.

The irreversible losses of energy causes a reduction in the flow pressure, and they derive from the friction, from a disturbance at the diffusor (second region 'B') introduced by the admission of gas at the throat (second region 'B'), and from a disturbance introduced by the fixing rods 41 of the central body venturi 40.

On the other hand, part of the kinetic energy of the gas will be converted to pressure, due to the deceleration in the flow at the diffusor (second region 'B'). The opening 25 acts then as an ejector. The area of the opening 25 is smaller than the area of the annulus 6, and consequently the average injection gas speed at the opening 25 is greater than the average injection gas speed in the annulus 6.

In the conventional gas lift system shown in FIG. 2 such kinetic energy is actually lost when mixing with the fluids of the flow coming from the reservoir. By using the present invention a great amount of such kinetic energy is recovered, and such recovering can compensate or even exceed the irreversible losses of energy.

However, it is not an object of the present invention to propose the use of injection gas as a motive fluid, as in the artificial lifting method known as jet pumping. The use of the gas in such a manner is very inefficient, as the low specific gravity of the injection gas determines that gas at a very high pressure and at a very high speed (flow rate) is used into the annulus, which is not desirable in practical use.

If the pressure $P_{tg}$ is smaller than the pressure $P_t$, it can be inferred how it enables to keep the injection gas flow rate constant and equal to the critical flow rate through a venturi type gas lift valve. As has been seen with respect to the system of FIGS. 2 and 3, the value of the pressure $P_t$ must be smaller than 90% of the value of the pressure $P_c$ for a critical gas flow rate to occur. Using the present invention, it is the value of the pressure $P_{tg}$ which must be smaller than 90% of the pressure $P_c$.

As the value of the pressure $P_{tg}$ is smaller than the value of the pressure $P_t$, due to the effect of the acceleration in the flow provoked by the throat (second region 'B') of the central body venturi 40, the pressure $P_t$ may reach greater values than those required in the normal situation, where the device of the invention is not used. For this it suffices that the central body venturi 40 is shaped with such a throat (second region 'B') that provides the desired effect.

Another advantage is that the value of the pressure $P_t$ may even be greater than the value of the pressure $P_c$. Usually, this would mean no gas injection is possible. However, the present invention enables the injection of gas at a region deeper than those of the gas lift systems where the device of the invention is not used, as in these systems the value of the pressure $P_c$ must be greater than the value of the pressure $P_t$.

Figure 6:
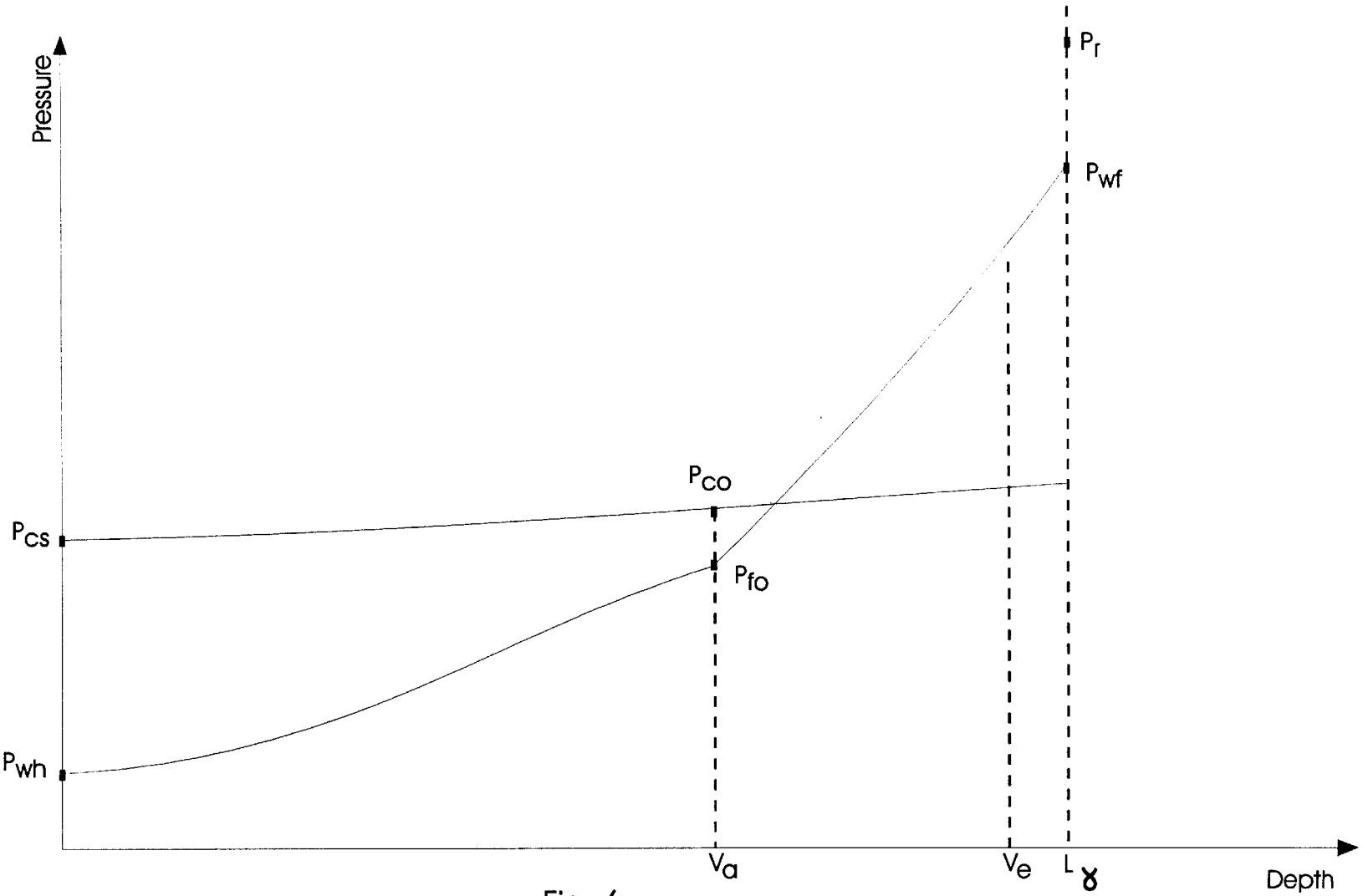
FIG. 6 is a chart of the pressures into the tubing and the annulus for an oil well provided with a conventional gas lift system.

FIG. 6 depicts a schematic chart of the pressures into the tubing and into the annulus for an oil well equipped with a conventional gas lift system. The chart shows the behavior of the pressure according to the depth of the well. The fluids flowing into the tubing must reach the wellhead at a pressure $P_{wh}$, which is the pressure required for the production facilities to operate. The available pressure at the surface of the gas to be injected into the annulus is $P_{cs}$.

Considering that a venturi type gas lift valve is located into the well at a depth $V_a$, the gas pressure $P_{co}$ into the annulus at this depth is greater than the pressure $P_{fo}$ of the flow into the tubing. Therefore, injection gas is injected by the venturi type gas lift valve into the tubing at a certain flow rate. In the region below the region where the venturi type gas lift valve is located, the pressure suffers an increase at a rate which is greater than the increase above the venturi type gas lift valve, due to the gas entering the tubing increasing the mass of fluids above the gas lift valve.

At a depth L. of the reservoir the pressure of the flow is $P_{wf}$. The differential between the static pressure of the reservoir $P_r$ and the pressure $P_{wf}$, which is also known as drawdown, causes a production of the fluids coming from the reservoir at a certain flow rate. The injection of gas at the depth $V_e$ is not possible with a conventional gas lift valve, as the pressure of injection gas in the annulus is smaller than the pressure of fluids in the tubing.

Figure 7:
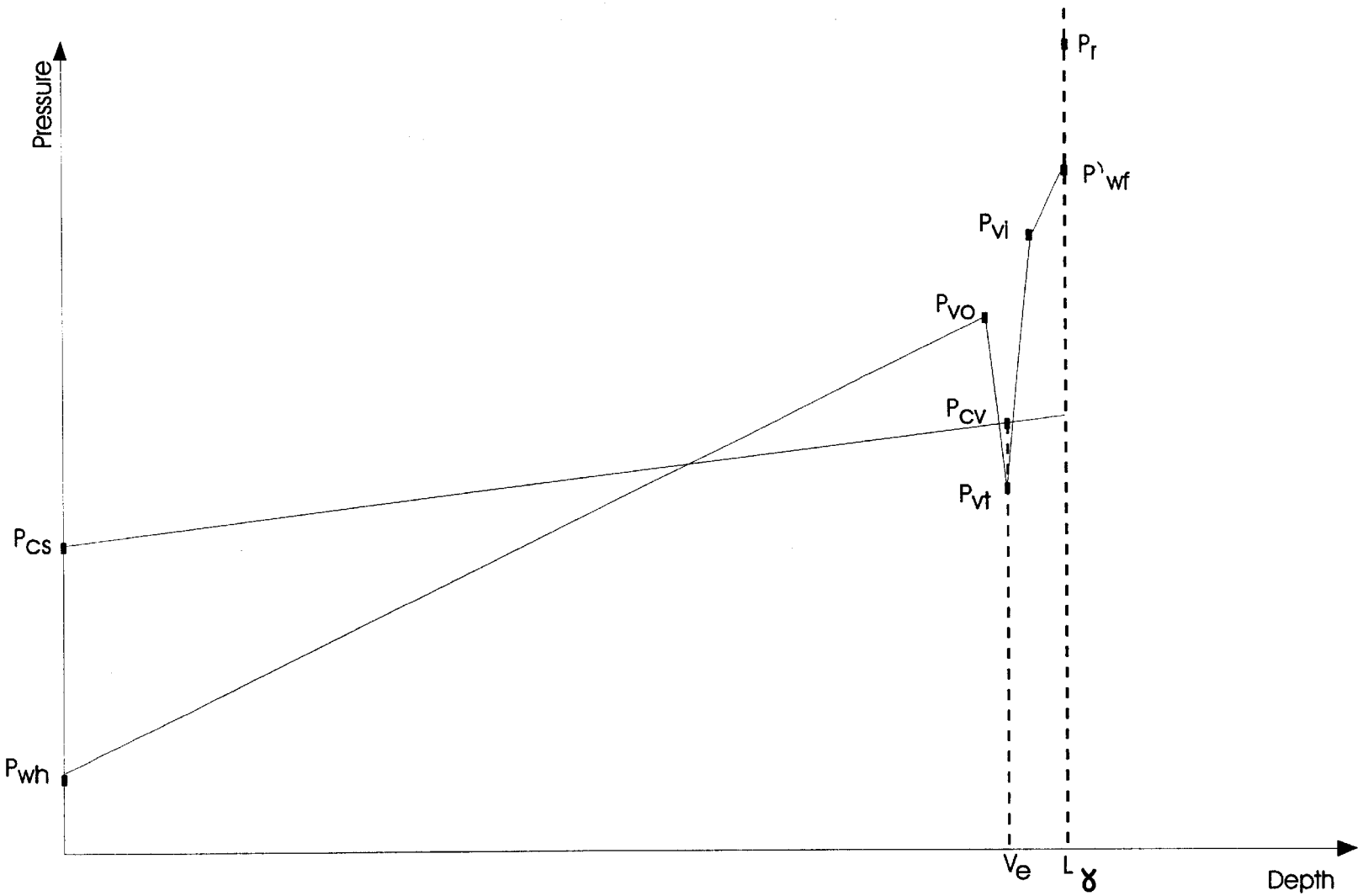
FIG. 7 is a chart of the pressures into the tubing and the annulus for an oil well provided with a continuous gas lift system when a device to stabilize the production of the present invention is provided to the tubing.

FIG. 7 shows a schematic chart of the pressures into the tubing and into the annulus for an oil well equipped to produce by means of continuous gas lift and which makes use of the device to stabilize the production of oil wells of the present invention.

A venturi type gas lift valve is located at the depth $V_e$, just in front of a central body venturi device similar to the one shown in FIGS. 4 and 5. The pressure of the gas into the annulus is $P_{cv}$, which is smaller than the pressure $P_{vi}$ of the flow into the tubing at a region located immediately below the central body venturi device.

As the flow passes through the central body venturi device, the pressure in the annulus between the throat (second region 'B') of the central body venturi 40 and the internal walls of the body 13 of the conventional gas lift mandrel 12 is reduced, reaching a value $P_{vt}$ which is smaller than the pressure $P_{cv}$, thereby enabling injection gas to be admitted into the tubing through the gas lift valve at a certain flow rate.

A recovering of pressure occurs at the diffusor (second region 'B') of the central body venturi device, and the pressure reaches a value $P_{vo}$. The flow of fluids continues to flow up to the surface, where the pressure reaches the value $P_{wh}$ required by the processing facilities to operate. At the depth $L_r$ of the reservoir the pressure of the flow is $P'_{wf}$, which is usually smaller than the value of the pressure $P_{wf}$ of the conventional situation (FIG. 6), thereby inducing the oil well to produce at a greater flow rate.

In the embodiment of FIG. 5, the injection gas is admitted into the throat (second region 'B') of the central body venturi 40 by means of a single opening 25, which is not the best way to admit the injection gas. It is therefore proposed to use a conventional gas lift mandrel in which the single opening 25 in which the injection of gas is made is replaced by a number of openings located in front of the throat (second region 'B') of the central body venturi 40.

FIG. 8 depicts a further embodiment of the present invention, showing an asymmetric body venturi 50 which also has a first convergent region or nozzle, denoted in FIG.

8 as A', a second constriction region or throat, denoted in FIG. 8 as B', and a third divergent region or diffusor, denoted in FIG. 8 as C'. The admission of the injection gas is also made in front of the throat (second region B') or at the beginning of the diffusor (third region C'), by means of the discharge opening 25. The asymmetric body venturi 50 is aerodynamically shaped and it can vary according to the needs, without departing from the teachings of the present invention.

FIG. 8A shows a cross-sectional view of the gas lift mandrel of FIG. 8, taken along the line 8A—8A in FIG. 8.

Figure 9:
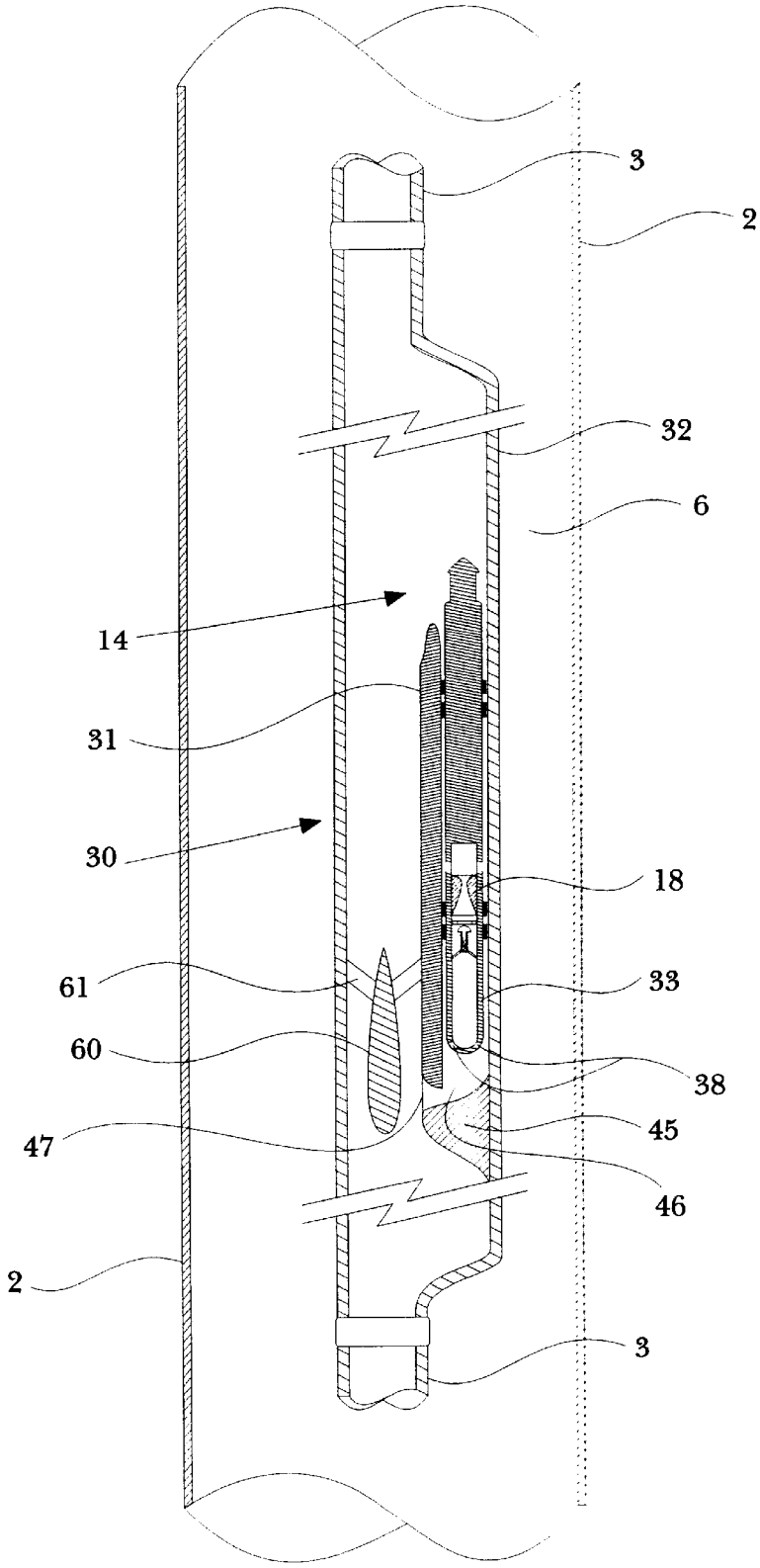
FIG. 9 is a longitudinal cross-sectional view depicting a side pocket gas lift mandrel having a venturi type gas lift valve connected to its side pocket, a device to stabilize the production of the present invention being provided into the tubing.

FIG. 9 depicts an embodiment of the device to stabilize the production of oil wells installed in a side pocket gas lift mandrel 30. The device to stabilize the production of oil wells comprises a central body venturi 60, which is equally shaped as the central body venturi 40 of the FIGS. 4 and 5, which also comprises a central aerodynamic element having a round cross section.

The central body venturi 60 is located in the side pocket gas lift mandrel 30, and it is fixed there by means of fixing elements 61, just in front of the region where a gas lift valve 14 is installed into a side receptacle 31 of the side pocket 32 of the side pocket gas lift mandrel 30. The axis of the central body venturi 60 is substantially parallel to the walls of the side pocket gas lift mandrel 30, and it is substantially centered in the region between the left wall of the side pocket gas lift mandrel 30, as shown in FIG. 9, and the side receptacle 31.

An aerodynamically shaped extension 45 is added to the lower part of the housing of the gas lift valve, as shown in FIG. 9. The extension 45 is provided with an internal passage 46 having a discharge opening 47. Therefore, the flow of injection gas coming from the discharge openings 38 of the gas lift valve 14 is directed to the throat of the central body venturi 60.

The same effects happen here as were described with respect to the central body venturi 40 of FIGS. 4 and 5, that is, the flow of fluids coming from the reservoir 1 is accelerated when passing through the region where the central body venturi 60 is installed, provoking there a reduction in the pressure of the flow.

Thus, the use of the extension 45 causes the flow of injection gas to be injected just in front of the throat of the central body venturi 60, thereby providing the same effect as that which has occurred with the use of the central body venturi 40 of the FIGS. 4 and 5, whereby the efficiency of the continuous gas lift is improved.

As with in the situation where a conventional gas lift mandrel is used in a continuous gas lift system, the embodiment depicted in FIG. 9 can also be made to provide a better distribution of the injection gas or, alternatively, geometrically eccentric central bodies can be used.

Those skilled in the art will immediately recognize that it is possible to use a number of variations in the geometric configuration of the device to stabilize the production of oil wells according to the present invention. The optimum dimensions for the central body venturi can be calculated by means of theoretical analysis, experimentation or empiricism. The throat may have a certain length or it can comprise just a very small segment.

The fixing elements of the central body venturi should preferably be fixed to the diffusor. As they cause an interference in the flow, the number of fixing elements should be as few as possible, and they should be thin and aerodynamically shaped.

The device proposed by the present invention preferably makes use of a central body venturi. However, other configurations of venturis or of nozzles may also be used, providing that the principle of the invention is used, that is, gas is injected at a constriction into the tubing, for example a throat of the central body venturi, which momentarily provokes the pressure of the flow to reduce at that constriction.

Figure 10:
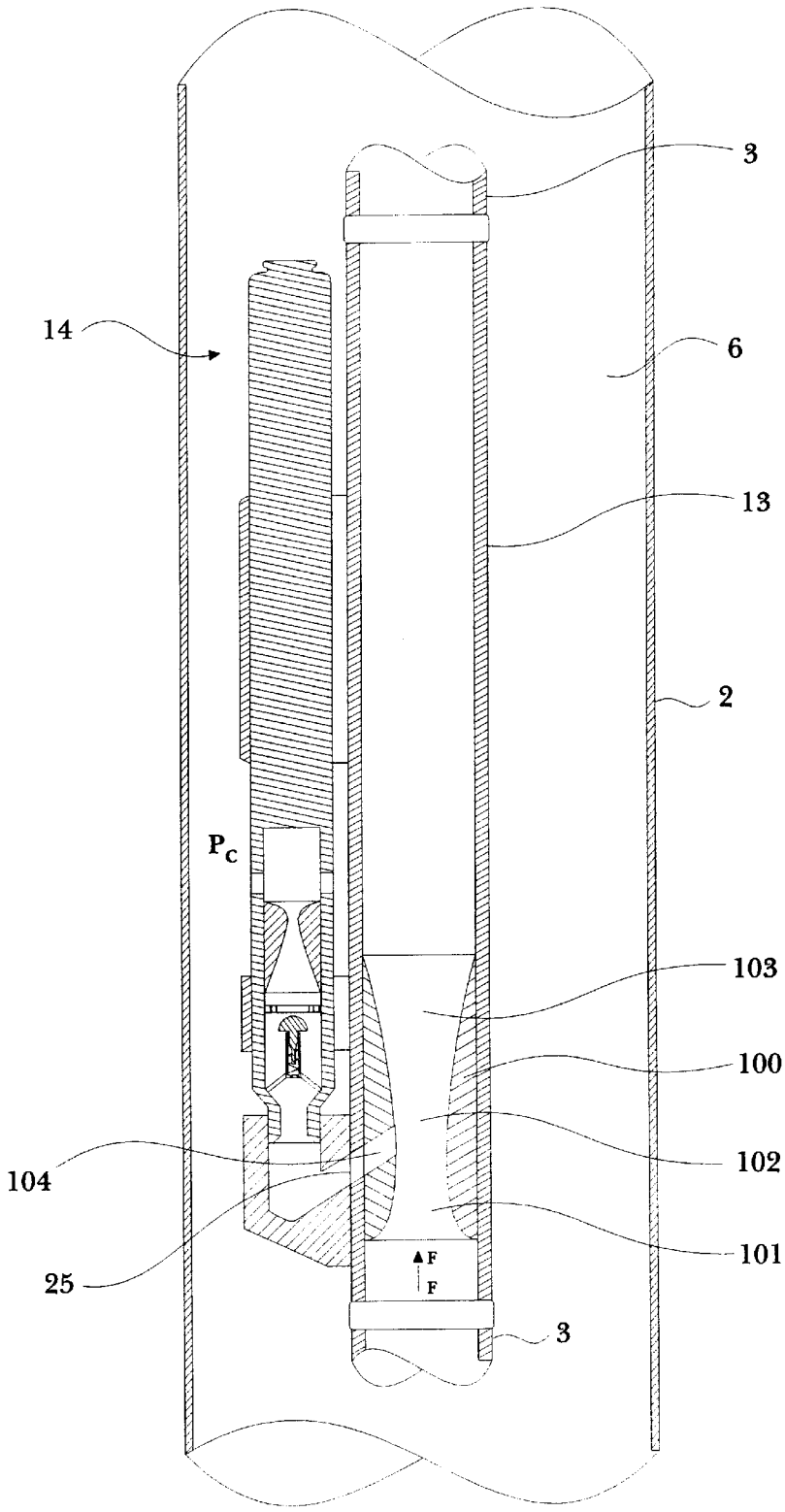
FIG. 10 is a longitudinal cross-sectional view depicting a conventional gas lift mandrel having a venturi type gas lift valve connected to it, a device to stabilize the production of the present invention being provided into the tubing.

FIG. 10 schematically depicts a conventional gas lift mandrel 12 provided with a concentric body venturi 100, which is provided with a convergent segment or nozzle 101, a segment of constant area or throat 102 and a divergent segment or diffusor 103. Gas is injected into the throat 102 of the concentric body venturi 100, by means of the opening 104, which is in registration with the discharge opening 25 which exits the high pressure injection gas coming from the gas lift valve 14.

Figure 11A:
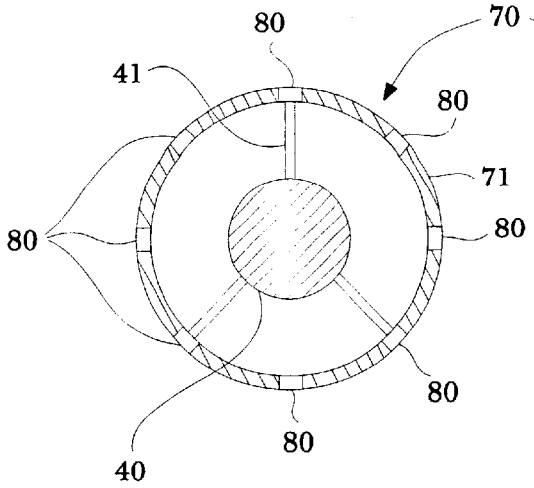
FIG. 11A is a transverse cross-section taken along the line 11A—11A of FIG. 11.
Figure 11:
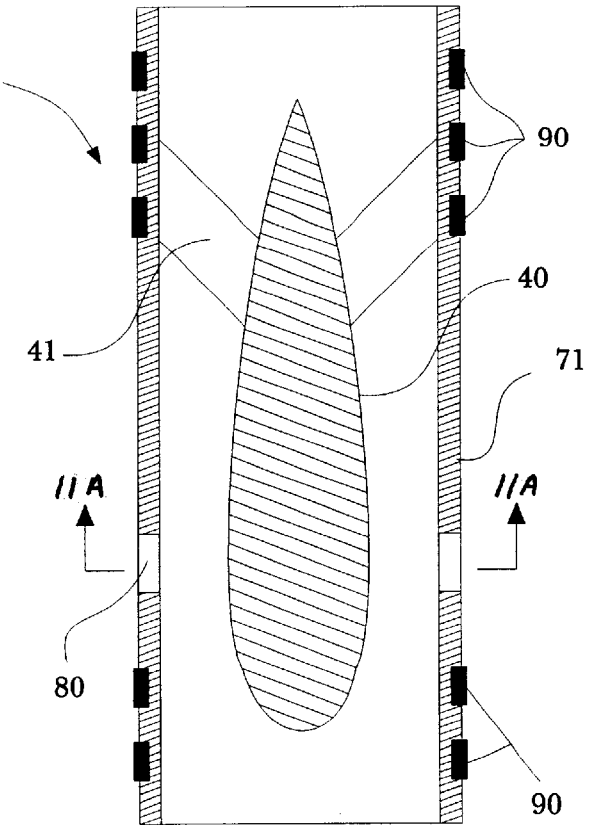
FIG. 11 is a longitudinal cross-sectional view depicting a first embodiment of a nipple for use with the device to stabilize the production according to the invention.

FIG. 11 schematically depicts an embodiment of a concentric body venturi device 40 into a small tube or nipple 70, which can be set at a desired position into the body of a gas lift mandrel. Such mandrel can be a conventional or a side pocket gas lift mandrel. Thin fixing elements 41 fix the central body venturi 40 to the body 71 of the nipple 70, keeping the central body venturi 40 centered.

In the present embodiment three fixing elements are used, although more or less fixing elements can be used, depending on the features of the design. Notice that the fixing elements are fixed to the diffusor of the central body venturi 40. Gas is admitted by means of at least one orifice 80 existing in the body 71 of the nipple 70, which is aligned with the throat of the central body venturi 40.

Two packing elements 90, located above and below the intake orifice 80, are intended to make a seal between the nipple 70 and the internal walls of the body of the gas lift mandrel, whereby the fluids from the reservoir are only allowed to pass through the right way into the device.

FIG. 11A depicts a cross section view of the nipple 70, taken along the line 11A—11A in FIG. 11.

Figures 12, 12A:
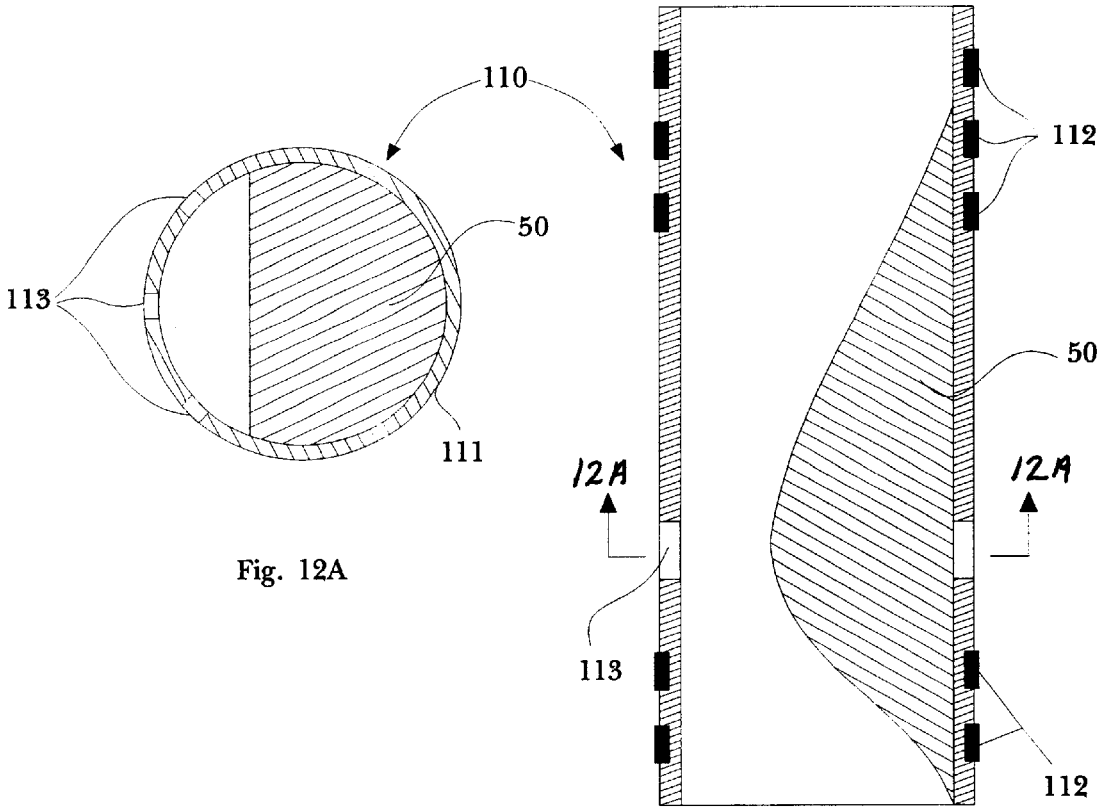
FIG. 12 is a longitudinal cross-sectional view depicting a second embodiment of a nipple for use with the device to stabilize the production according to the invention.
FIG. 12A is a transverse cross-section taken along the line 12A—12A of FIG. 12.

FIG. 12 schematically depicts a further embodiment of an asymmetric body venturi device 50 into a small tube or nipple 110, which can be set at a desired position inside the body of a gas lift mandrel. Such mandrel can be a conventional or a side pocket gas lift mandrel. The asymmetric body venturi device 50 is fixed to the walls of the body 111 of the nipple 110. Gas is admitted by means of at least one orifice 113 existing in the body 111 of the nipple 110, which is aligned with the throat of the asymmetric body venturi 50.

Two packing elements 112 are located above and below the intake orifice 113, intended to make a seal between the nipple 110 and the internal walls of the body of the gas lift mandrel, whereby the fluids from the reservoir are only allowed to pass through the right way into the device.

The FIG. 12A depicts a cross section view of the nipple 110, taken along the line 12A—12A in FIG. 12.

Figure 13A:
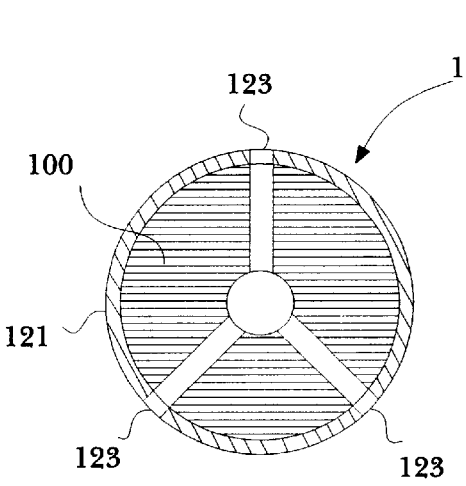
FIG. 13A is a transverse cross-section taken along the line 13A—13A of FIG. 13.
Figure 13:
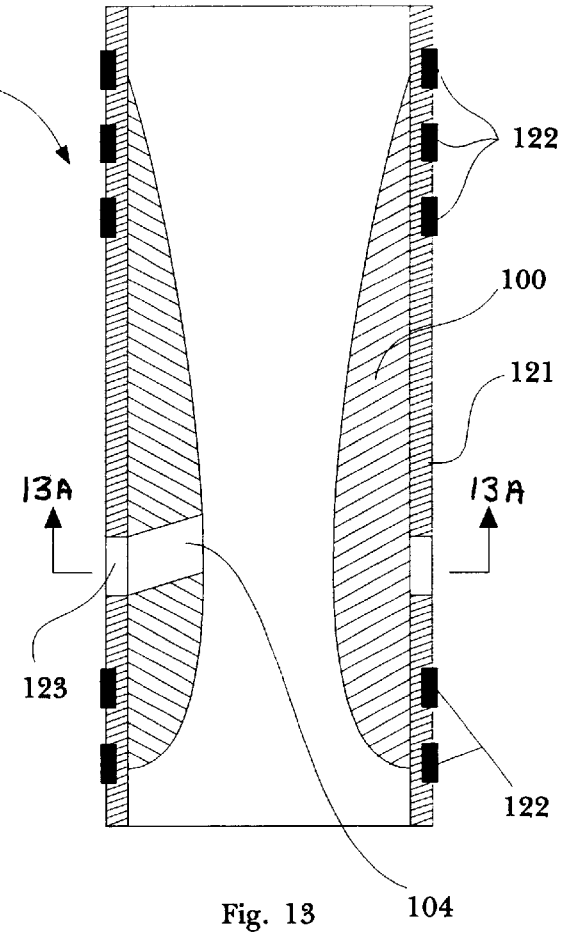
FIG. 13 is a longitudinal cross section view depicting a third embodiment of a nipple for use with the device to stabilize the production according to the invention.

The FIG. 13 schematically depicts a further embodiment of a concentric body venturi device 100 in a small tube or nipple 120, which can be set at a desired position inside the body of a gas lift mandrel. Such mandrel can be a conventional or a side pocket gas lift mandrel. The concentric body venturi device 100 is fixed to the walls of the body 121 of the nipple 120. Gas is admitted by means of at least one orifice 123 existing in the body 121 of the nipple 120, which is aligned with the throat of the concentric body venturi 100.

Two packing elements 122, located above and below the intake orifice 123, are intended to make a seal between the nipple 120 and the internal walls of the body of the gas lift mandrel, whereby the fluids from the reservoir are only allowed to pass through the right way into the device.

FIG. 13A depicts a cross section view of the nipple 120, taken along the line 13A—13A in FIG. 13.

The actual installation of a nipple into a gas lift mandrel is an operation well known by the experts, and it will not be described here for the sake of simplification of the description.

The device to stabilize the production of oil wells of the present invention may be preferably used with a venturi type gas lift valve. However, such device can also be used with other types of gas lift valves, although not so efficiently, for example, the conventional gas lift valve having an orifice plate with sharp edges.

The present invention is mainly directed to oil wells equipped to produce by means of continuous gas lift. However, the device of the present invention can also be used in oil wells which naturally flow but which have a flow of fluids that is unstable. The invention can cause the flow of such oil wells to become stable, using or not the injection of gas in conjunction with the device.

Having described the present invention with respect to its preferred embodiments, it should be mentioned that the present invention is not limited to the description heretofore made, being only limited by the scope of the appended claims.

What is claimed is:

1. An oil well into which an unstable fluid flow occurs, said oil well comprising:

a tubing for conducting fluids from an oil reservoir to a wellhead at a surface;

a casing surrounding said tubing; and a packer inserted and locked into said casing and connected to said tubing proximate the oil reservoir, so as to create two discrete regions in said oil well, one said region being a lower chamber, extending downwardly from the packer to said reservoir, and the other said region being an annulus between said casing and said tubing and extending upwardly from the packer to the wellhead;

said oil well further comprising:

a body disposed in said tubing, vertically above said packer, said body consisting essentially of:

a first portion that progressively reduces, in a direction of fluid flow in said tubing, a cross-sectional flow area for the passage of fluid;

a second portion, disposed downstream of said first portion with respect to the direction of fluid flow in said tubing, that defines a substantially constant cross-sectional flow area for the passage of fluid, said constant cross-sectional area being smaller than an unobstructed interior cross-sectional area of said tubing; and a third portion, disposed downstream of said second portion, that progressively increases, in the direction of fluid flow in said tubing, a cross-sectional flow area for the passage of fluid;

whereby said unstable fluid flow becomes stable after passing through the portion of said tubing where said body is located.

2. An oil well comprising:

a tubing for conducting fluids from an oil reservoir to a wellhead at a surface;

a casing surrounding said tubing; and a packer inserted and locked into said casing and connected to said tubing proximate the oil reservoir, so as to create two discrete regions in said oil well, one said region being a lower chamber, extending downwardly from the packer to said reservoir, and the other said region being an annulus between said casing and said tubing and extending upwardly from the packer to the wellhead;

said oil well further comprising:

a body disposed in said tubing, said body comprising:

a first portion that progressively reduces, in a direction of fluid flow in said tubing, a cross-sectional flow area for the passage of fluid;

a second portion, disposed downstream of said first portion with respect to the direction of fluid flow in said tubing, that defines a substantially constant cross-sectional flow area for the passage of fluid, said constant cross-sectional area being smaller than an unobstructed interior cross-sectional area of said tubing;

a third portion, disposed downstream of said second portion, that progressively increases, in the direction of fluid flow in said tubing, a cross-sectional flow area for the passage of fluid, whereby said unstable fluid flow becomes stable after passing through the region in said tubing where said body is located; and a gas lift valve for injecting gas into said tubing.

3. An oil well according to claim 2, wherein said gas lift valve is connected to a gas lift mandrel forming a portion of said tubing, said body being provided adjacent to an opening of said gas lift mandrel.

4. An oil well according to claim 3, wherein said body is provided such that an injection gas is injected into a portion of said tubing in which said second portion of said body is disposed.

5. An oil well according to claim 4, wherein said gas lift mandrel is a side pocket gas lift mandrel provided with an internal passage having a discharge opening for said injection gas.

6. An oil well according to claim 5, wherein said discharge opening is directed to inject said injection gas towards said second portion of said body.

7. An oil well according to claim 6, wherein said gas lift valve is provided with a venturi for controlling the injection of said injection gas.

8. An oil well according claim 7, wherein said body is provided internally to a nipple tubing which is removably provided internally to said tubing.

9. An oil well according to claim 8, wherein said nipple tubing comprises an intake orifice aligned with said second portion of said body, said intake orifice allowing the passage of said injection gas.

10. An oil well according to claim 9, further comprising at least two packing elements respectively located above and below said intake orifice to make a seal between the external walls of said nipple tubing and the internal walls of said tubing.

11. An oil well according to claim 10, wherein said body defines a central body venturi.

12. An oil well according to claim 10, wherein said body defines an asymmetric body venturi.

13. An oil well according to claim 10, wherein said body defines a concentric body venturi.

14. An oil well according to claim 13, wherein said concentric body venturi is provided with an opening communicating with said discharge opening.

15. An oil well according to claim 4, wherein said opening of said gas lift mandrel is directed to inject said injection gas towards said second portion of said body.

16. An oil well according to claim 15, wherein said gas lift valve is provided with a venturi for controlling the injection of said injection gas.

17. An oil well according claim 16, wherein said body is provided internally to a nipple tubing which is removably provided internally to said tubing.

18. An oil well according to claim 17, wherein said nipple tubing comprises an intake orifice aligned with said second portion of said body, said intake orifice allowing the passage of said injection gas.

19. An oil well according to claim 18, further comprising at least two packing elements respectively located above and below said intake orifice to make a seal between the external walls of said nipple tubing and the internal walls of said tubing.

20. An oil well according to claim 19, wherein said body defines a central body venturi.

21. An oil well according to claim 19, wherein said body defines an asymmetric body venturi.

22. An oil well according to claim 19, wherein said body defines a concentric body venturi.

23. An oil well according to claim 22, wherein said concentric body venturi is provided with an opening communicating with said opening of said gas lift mandrel.

24. A body to stabilize the production of oil wells when provided in a tubing for conducting fluids coming from an oil reservoir, said body consisting essentially of:

a first portion which progressively increases in cross sectional area from a distal end thereof causing a progressive decrease, in a direction of fluid flow from said oil reservoir, in a cross-sectional area available for the passage of fluid from said oil reservoir when said body is inserted inside said tubing;

a second portion disposed adjacent to said first portion which has a substantially constant cross-sectional area defining a substantially constant cross-sectional area available for the passage of fluid when said body is inserted inside said tubing, said constant area being smaller than an unobstructed interior cross-sectional area of said tubing; and a third portion disposed adjacent to said second portion which progressively decreases in cross-sectional area from a distal end thereof causing a progressive increase, in the direction of fluid flow, in a cross-sectional area available for the passage of fluid when said body is inserted inside said tubing.

25. A body according to claim 24, wherein said body is a central body venturi having a lower portion defined by said first portion which progressively increases in cross-sectional area up to an intermediate portion defined by said second portion, which has a constant cross-sectional area, and an upper portion defined by said third portion progressively decreasing in cross-sectional area from said intermediate portion.

26. A body according to claim 24, wherein said body is an asymmetric body venturi constructed to abut an inner cylindrical wall of said tubing.

27. A body according to claim 24, wherein said body is a concentric body venturi constructed to abut an inner cylindrical wall of said tubing.

28. A body according to claim 27, wherein said body comprises an opening for communication with a discharge opening of a gas lift valve.

29. A device to stabilize the production of oil wells, said device comprising:

a body to stabilize the production of oil wells when provided to a tubing for conducting fluids coming from a reservoir; said body comprising:

a first portion which progressively increases in cross-sectional area from a distal end thereof causing a progressive decrease, in a direction of fluid flow from said reservoir, in cross-sectional area available for the passage of fluid when said body is inserted inside said tubing;

a second portion disposed adjacent to said first portion which has a substantially constant cross-sectional area defining a substantially constant cross-sectional area available for the passage of fluid when said body is inserted inside said tubing, said constant area being smaller than an unobstructed interior cross-sectional area of said tubing;

a third portion disposed adjacent to said second portion which progressively decreases in cross-sectional area from a distal end thereof causing a progressive increase, in the direction of fluid flow, in a cross-sectional area available for the passage of fluid when said body is inserted inside said tubing; and a nipple tubing surrounding, and attached to, said body, said nipple tubing being insertable into said tubing of an oil well.

30. A device according to claim 29, wherein said nipple tubing further comprises at least one intake orifice facing said intermediate portion of said body for the passage of injection gas.

31. A device according to claim 30, further comprising at least two packing elements disposed respectively above and below said at least one intake orifice for providing a seal between said nipple tubing and internal walls of a tubing of an oil well.

32. A method to stabilize the production of oil wells into which an unstable fluid flow occurs, said oil well comprising a tubing for conducting fluids from an oil reservoir to a well head at a surface, the method comprising:

inserting into said tubing a device consisting essentially of:

a first portion that progressively reduces, in a direction of fluid flow, a cross-sectional flow area for the passage of fluid flowing from said oil reservoir;

a second portion, disposed vertically above said first portion, defining a substantially constant cross-sectional flow area for the passage of fluid coming from said reservoir and smaller than an unobstructed interior cross-sectional area of said tubing;

a third portion, disposed vertically above said second portion, defining a progressively increasing, in a direction of fluid flow, cross-sectional area for the passage of fluid coming from said reservoir, until said cross-sectional area for the passage of fluid is equal to an unobstructed interior cross-sectional area of said tubing;

allowing fluids from said oil reservoir to flow towards said surface past said device, whereby said flow is accelerated when it passes said first portion, and consequently the flow pressure is decreased, said flow then, passing said second portion, and then passing said third portion, where said flow is decelerated, and consequently the flow pressure is increased, the above sequence causing a stabilization of said flow.

33. A method to stabilize the production of oil wells comprising a tubing for conducting fluids from an oil reservoir to a well head at a surface, the method comprising:

inserting into said tubing a device comprising:

a first portion that progressively reduces, in a direction of fluid flow, a cross-sectional flow area for the passage of fluid flowing from said oil reservoir;

a second portion, disposed vertically above said first portion, defining a substantially constant cross-sectional flow area for the passage of fluid coming from said reservoir and smaller than an unobstructed interior cross-sectional area of said tubing;

a third portion, disposed vertically above said second portion, defining a progressively increasing, in a direction of fluid flow, cross-sectional area for the passage of fluid coming from said reservoir, until said cross-sectional area for the passage of fluid is equal to an unobstructed interior cross-sectional area of said tubing;

allowing fluids from said oil reservoir to flow towards said surface past said device, whereby said flow is accelerated when it passes said first portion, and consequently the flow pressure is decreased, said flow then, passing said second portion, and then passing said third portion, where said flow is decelerated, and consequently the flow pressure is increased, the above sequence causing a stabilization of said flow, wherein:

said oil well is equipped to produce by means of a gas lifting system;

a gas lift mandrel forms part of said tubing; and a gas lift valve is connected to said gas lift mandrel, said gas lift valve being provided with at least one opening through which injection gas at a high pressure from an annulus between said tubing and a well casing is able to flow towards a discharge opening in said gas lift mandrel, so that injection gas at a high pressure is injected into said tubing.

34. A method according to claim 33, wherein said device is aligned with said gas lift valve, with said second portion facing said discharge opening to inject injection gas at a high pressure into said tubing.

35. A method according to the claim 33, wherein said device is shaped in such a way that a drop in pressure occurring in the region of said second portion of said device enables a constant gas flow rate to occur throughout said gas lift valve, substantially independent of the pressure into said tubing.

36. A method according to the claim 33, wherein said device is shaped in such a way that the drop in pressure occurring in the region of said second portion of said device enables a constant gas flow rate to occur throughout said gas lift valve, substantially independent of the pressure into said tubing.

* * * * *